US011553784B2

(12) United States Patent
Jungnickel

(10) Patent No.: US 11,553,784 B2
(45) Date of Patent: Jan. 17, 2023

(54) HEAD FOR AN ORAL CARE IMPLEMENT AND ORAL CARE IMPLEMENT

(71) Applicant: The Gillette Company LLC, Boston, MA (US)

(72) Inventor: Uwe Jungnickel, Königstein (DE)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 16/829,585

(22) Filed: Mar. 25, 2020

(65) Prior Publication Data

US 2020/0305588 A1 Oct. 1, 2020

(30) Foreign Application Priority Data

Mar. 29, 2019 (EP) ..... 19166091

(51) Int. Cl.
*A46B 9/02* (2006.01)
*A46B 9/04* (2006.01)
*A46B 9/06* (2006.01)

(52) U.S. Cl.
CPC ..... *A46B 9/04* (2013.01); *A46B 9/02* (2013.01); *A46B 9/028* (2013.01); *A46B 9/06* (2013.01)

(58) Field of Classification Search
CPC ..... A46B 9/06; A46B 9/02; A46B 9/025
See application file for complete search history.

(56) References Cited

U.S. PATENT DOCUMENTS 3,927,435 A 12/1975 Moret
4,384,645 A 5/1983 Manfredi
(Continued)

FOREIGN PATENT DOCUMENTS

CN 2320102 5/1999
CN 1223834 7/1999
(Continued)

OTHER PUBLICATIONS

All Office Actions; U.S. Appl. No. 17/511,103, filed Oct. 26, 2021.
(Continued)

*Primary Examiner* — Shay Karls
(74) *Attorney, Agent, or Firm* — Vladimir Vitenberg; Gregory S. Darley-Emerson

(57) ABSTRACT

A head for an oral care implement has a longitudinal length extension extending between a proximal end and a distal end, an outer rim and an inner portion. The head comprises at least two tooth cleaning elements of a first type and a plurality of tooth cleaning elements of a second type, the tooth cleaning elements of the first type being arranged at the inner portion of the head, and the plurality of tooth cleaning elements of the second type being arranged at the outer rim of the head, thereby surrounding the tooth cleaning elements of the first type. The tooth cleaning elements of the first type are tufts of a first type comprising a plurality of filaments. The tufts of the first type are arranged substantially parallel to each other. Each tuft has a substantially rectangular or oval cross-sectional shape with a longer length extension from about 4 mm to about 8 mm and a shorter width extension from about 1.5 mm to about 2.5 mm, wherein the longer length extension defines an angle α with respect to the longitudinal length extension of the head of about 25° to about 60°.

22 Claims, 6 Drawing Sheets

(56) References Cited

U.S. PATENT DOCUMENTS 4,811,445 A 3/1989 Lagieski et al.
5,109,563 A 5/1992 Lemon et al.
5,335,389 A 8/1994 Curtis et al.
5,361,446 A 11/1994 Rufo
5,369,835 A 12/1994 Clarke
5,875,510 A 3/1999 Lamond et al.
5,956,796 A 9/1999 Lodato
5,992,423 A 11/1999 Tevolini
6,015,328 A 1/2000 Glaser
6,086,373 A * 7/2000 Schiff ..... A46D 1/00 15/167.1
6,230,716 B1 5/2001 Minoletti
6,308,367 B1 10/2001 Beals et al.
6,643,886 B2 11/2003 Moskovich
6,671,919 B2 1/2004 Davis
6,871,373 B2 * 3/2005 Driesen ..... A46D 1/00 15/167.1
7,137,166 B1 11/2006 Kraemer
8,387,197 B2 3/2013 Moskovich
8,563,020 B2 10/2013 Uhlmann
8,727,141 B2 5/2014 Akalin
8,931,855 B1 1/2015 Foley et al.
8,966,697 B2 3/2015 Kim et al.
9,049,921 B1 6/2015 Rackston
9,066,579 B2 6/2015 Hess
9,161,544 B2 10/2015 Agrawal et al.
9,168,117 B2 10/2015 Yoshida et al.
9,226,508 B2 1/2016 Uhlmann et al.
9,265,335 B2 2/2016 Foley et al.
9,402,461 B2 8/2016 Brik et al.
9,427,077 B1 8/2016 Zhang
D775,469 S 1/2017 Sikora et al.
9,539,750 B2 1/2017 Gross et al.
9,609,940 B2 4/2017 Corbett
9,642,682 B2 5/2017 Kato
D814,195 S 4/2018 Sikora et al.
10,195,005 B2 2/2019 Wallström et al.
10,667,892 B2 6/2020 Bärtschi et al.
10,792,136 B2 10/2020 May et al.
D901,183 S 11/2020 Jungnickel et al.
D912,988 S 3/2021 Langhammer
D917,298 S 4/2021 Hallein et al.
D926,048 S 7/2021 Hallein et al.
D926,049 S 7/2021 Hallein et al.
D927,972 S 8/2021 Hallein et al.
D930,990 S 9/2021 Hallein et al.
D931,617 S 9/2021 Hallein et al.
D931,619 S 9/2021 Hallein et al.
D933,368 S 10/2021 Albay et al.
D936,484 S 11/2021 Hallein et al.
2003/0115706 A1 6/2003 Ponzini
2004/0016073 A1 1/2004 Knutson
2004/0060138 A1 4/2004 Pfenniger et al.
2005/0022322 A1 2/2005 Jimenez et al.
2005/0268414 A1 * 12/2005 Kim ..... A46B 9/04 15/167.1
2005/0286967 A1 12/2005 Blauzdys
2006/0086370 A1 4/2006 Omeara
2008/0120795 A1 5/2008 Reinbold
2008/0220235 A1 9/2008 Izumi
2009/0089950 A1 4/2009 Moskovich et al.
2010/0115724 A1 5/2010 Huang
2010/0282274 A1 11/2010 Huy
2011/0016651 A1 1/2011 Piserchio
2011/0146015 A1 6/2011 Moskovich
2011/0314677 A1 12/2011 Meier et al.
2012/0036663 A1 2/2012 Chen
2012/0073072 A1 3/2012 Moskovich et al.
2012/0090117 A1 4/2012 Akalin
2012/0198640 A1 8/2012 Jungnickel et al.
2012/0227200 A1 9/2012 Kraemer
2012/0301528 A1 11/2012 Uhlmann
2012/0301530 A1 11/2012 Uhlmann et al.
2012/0301531 A1 11/2012 Uhlmann et al.
2012/0301533 A1 11/2012 Uhlmann et al.
2013/0000059 A1 1/2013 Jungnickel et al.
2013/0171225 A1 7/2013 Uhlmann et al.
2013/0291326 A1 11/2013 Mintel
2013/0315972 A1 11/2013 Krasnow et al.
2014/0137349 A1 5/2014 Newman
2014/0259474 A1 9/2014 Sokol et al.
2014/0359957 A1 12/2014 Jungnickel
2014/0359958 A1 12/2014 Jungnickel
2015/0034858 A1 2/2015 Raman
2015/0143651 A1 5/2015 Foley et al.
2015/0147372 A1 5/2015 Agrawal et al.
2015/0245618 A9 9/2015 Agrawal et al.
2015/0289635 A1 10/2015 Erskine-Smith
2015/0305487 A1 10/2015 Pardo et al.
2015/0351406 A1 12/2015 Wingfield et al.
2016/0135579 A1 5/2016 Tschol et al.
2016/0135580 A1 5/2016 Tschol et al.
2016/0220014 A1 8/2016 Sprosta
2017/0079418 A1 3/2017 Mintel
2017/0347782 A1 12/2017 Jimenez et al.
2017/0347786 A1 12/2017 Jimenez et al.
2017/0367469 A1 12/2017 Jimenez et al.
2018/0016408 A1 1/2018 Stibor
2018/0055206 A1 * 3/2018 Nelson ..... A46D 1/05
2018/0311023 A1 * 11/2018 Yao ..... A61C 17/0211
2019/0000223 A1 1/2019 Alinski
2019/0069978 A1 3/2019 Katano et al.
2019/0104835 A1 * 4/2019 Alinski ..... A46D 1/0238
2019/0117356 A1 4/2019 Bartschi et al.
2019/0200740 A1 7/2019 Jungnickel
2019/0200742 A1 7/2019 Jungnickel
2019/0200743 A1 7/2019 Jungnickel
2019/0200748 A1 7/2019 Görich
2019/0246779 A1 8/2019 Jungnickel et al.
2019/0246780 A1 8/2019 Jungnickel et al.
2019/0246781 A1 8/2019 Jungnickel et al.
2019/0248049 A1 8/2019 Jungnickel et al.
2020/0022793 A1 1/2020 Scherrer et al.
2020/0077778 A1 3/2020 Jungnickel
2020/0121069 A1 4/2020 Jungnickel
2021/0120948 A1 4/2021 Görich et al.
2021/0128286 A1 5/2021 Jungnickel et al.
2021/0212446 A1 7/2021 Jungnickel
2021/0212447 A1 7/2021 Jungnickel et al.
2021/0212448 A1 7/2021 Jungnickel
2021/0220101 A1 7/2021 Jungnickel et al.
2021/0259818 A1 8/2021 Jungnickel et al.
2021/0307496 A1 10/2021 Jungnickel et al.
2021/0315368 A1 10/2021 Jungnickel
2021/0315369 A1 10/2021 Jungnickel
2021/0315370 A1 10/2021 Jungnickel
2021/0315675 A1 10/2021 Jungnickel

FOREIGN PATENT DOCUMENTS

CN 1229341 A 9/1999
CN 1229622 9/1999
CN 2346277 11/1999
CN 1241123 A 1/2000
CN 201036392 3/2008
CN 201185740 1/2009
CN 201630520 11/2010
CN 201675294 12/2010
CN 201861064 6/2011
CN 201861068 6/2011
CN 202035662 11/2011
CN 202269590 U 6/2012
CN 202286879 7/2012
CN 202476817 10/2012
CN 102907880 2/2013
CN 102948997 3/2013
CN 202820100 3/2013
CN 202941615 5/2013
CN 202980745 6/2013
CN 103829559 6/2014
CN 103844575 6/2014
CN 104768420 A 7/2015
CN 105054571 11/2015
CN 205082879 3/2016

(56) References Cited

FOREIGN PATENT DOCUMENTS

| | | | | |
|---|---|---|---|---|
| CN | 105534002 | | 5/2016 | |
| CN | 105750734 | | 7/2016 | |
| CN | 105818322 | | 8/2016 | |
| CN | 205568222 | | 9/2016 | |
| CN | 106132244 | A | 11/2016 | |
| CN | 106793866 | A | 5/2017 | |
| CN | 206714397 | | 12/2017 | |
| CN | 207055161 | | 3/2018 | |
| CN | 109259882 | A | 1/2019 | |
| CN | 111713845 | A | 9/2020 | |
| DE | 3241118 | A1 | 8/1984 | |
| DE | 202005002964 | | 7/2005 | |
| DE | 202006019788 | | 8/2007 | |
| DE | 102006051649 | | 5/2008 | |
| DE | 202015002964 | U1 | 8/2015 | |
| EP | 0100975 | A2 | 2/1984 | |
| EP | 0481553 | A1 | 4/1992 | |
| EP | 2117395 | A2 | 11/2009 | |
| EP | 2218559 | A1 | 8/2010 | |
| EP | 2685932 | A1 * | 1/2014 | ..... A46D 1/00 |
| EP | 3090646 | | 11/2016 | |
| EP | 3381404 | A1 | 10/2018 | |
| EP | 3501333 | A1 | 6/2019 | |
| FR | 2835176 | | 8/2003 | |
| GB | 766486 | | 1/1957 | |
| GB | 2493409 | | 2/2013 | |
| JP | 61020509 | | 1/1986 | |
| JP | S63284262 | | 11/1988 | |
| JP | H0669408 | | 3/1994 | |
| JP | 2561978 | | 12/1996 | |
| JP | 2619825 | | 6/1997 | |
| JP | 2003009951 | | 1/2003 | |
| JP | 2003245132 | | 9/2003 | |
| JP | 2004089471 | | 3/2004 | |
| JP | 2005053973 | | 3/2005 | |
| JP | 4076405 | | 2/2008 | |
| JP | 2009011621 | | 1/2009 | |
| JP | 2011045621 | | 3/2011 | |
| JP | 2011087747 | | 5/2011 | |
| JP | 2015231500 | A | 12/2015 | |
| JP | 6160619 | B2 | 6/2017 | |
| JP | 3213325 | | 11/2017 | |
| KR | 20070013844 | | 1/2007 | |
| KR | 20090030829 | | 3/2009 | |
| KR | 101142611 | | 5/2012 | |
| KR | 20130006243 | U | 10/2013 | |
| KR | 101339558 | | 12/2013 | |
| KR | 200473116 | | 6/2014 | |
| KR | 20150057308 | | 5/2015 | |
| KR | 20150105813 | | 9/2015 | |
| KR | 101591299 | | 2/2016 | |
| KR | 20160125725 | | 11/2016 | |
| KR | 20170062779 | | 6/2017 | |
| KR | 101847473 | B1 | 4/2018 | |
| KR | 200486759 | Y1 | 6/2018 | |
| KR | 101987341 | B1 | 6/2019 | |
| RU | 2141238 | | 11/1999 | |
| WO | 9510959 | | 4/1995 | |
| WO | 9838889 | | 9/1998 | |
| WO | 9844823 | A2 | 10/1998 | |
| WO | 2005002826 | A1 | 1/2005 | |
| WO | 2005030002 | | 4/2005 | |
| WO | 200641658 | | 4/2006 | |
| WO | 2008098107 | A2 | 8/2008 | |
| WO | 2009045982 | A1 | 4/2009 | |
| WO | WO2012126126 | | 9/2012 | |
| WO | 2012144328 | | 10/2012 | |
| WO | 2013076904 | | 5/2013 | |
| WO | 2013101300 | A1 | 7/2013 | |
| WO | 2013158741 | | 10/2013 | |
| WO | 2014193621 | | 12/2014 | |
| WO | 2015061651 | A1 | 4/2015 | |
| WO | 2016189407 | A1 | 12/2016 | |
| WO | 2017173768 | A1 | 10/2017 | |
| WO | WO2018025751 | | 2/2018 | |
| WO | 2019072925 | A1 | 4/2019 | |
| WO | 2019157787 | A1 | 8/2019 | |

OTHER PUBLICATIONS

Ail Office Actions; U.S. Appl. No. 17/517,928, filed Nov. 3, 2021.
All Office Actions; U.S. Appl. No. 17/517,937, filed Nov. 3, 2021.
All Office Actions; U.S. Appl. No. 17/517,957, filed Nov. 3, 2021.
All Office Actions; U.S. Appl. No. 17/517,975, filed Nov. 3, 2021.
All Office Actions; U.S. Appl. No. 17/517,990, filed Nov. 3, 2021.
All Office Actions; U.S. Appl. No. 17/517,999, filed Nov. 3, 2021.
All Office Actions; U.S. Appl. No. 17/518,009, filed Nov. 3, 2021.
U.S. Appl. No. 17/511,103, filed Oct. 26, 2021, to first inventor et. al.
U.S. Appl. No. 17/517,928, filed Nov. 3, 2021 to first inventor et. al.
U.S. Appl. No. 17/517,937, filed Nov. 3, 2021, to first inventor et. al.
U.S. Appl. No. 17/517,957, filed Nov. 3, 2021, to first inventor et. al.
U.S. Appl. No. 17/517,975, filed Nov. 3, 2021, to first inventor et. al.
U.S. Appl. No. 17/517,990, filed Nov. 3, 2021, to first inventor et. al.
U.S. Appl. No. 17/517,999, filed Nov. 3, 2021 to first inventor et. al.
U.S. Appl. No. 17/518,009, filed Nov. 3, 2021 to first inventor et. al.
U.S. Appl. No. 29/819,318, filed Dec. 14, 2021, Devran Albay et al.
U.S. Appl. No. 29/814,060, filed Nov. 3, 2021 Christine Hallein et al.
U.S. Appl. No. 29/814,616, filed Nov. 8, 2021 Christine Hallein et al.
All Office Actions; U.S. Appl. No. 16/225,509, filed Dec. 19, 2018.
All Office Actions; U.S. Appl. No. 16/225,592, filed Dec. 19, 2018.
All Office Actions; U.S. Appl. No. 16/225,688, filed Dec. 19, 2018.
All Office Actions; U.S. Appl. No. 16/225,809, filed Dec. 19, 2018.
All Office Actions; U.S. Appl. No. 16/272,392, filed Feb. 11, 2019.
All Office Actions; U.S. Appl. No. 16/272,422, filed Feb. 11, 2019.
All Office Actions; U.S. Appl. No. 16/272,872, filed Feb. 11, 2019.
All Office Actions; U.S. Appl. No. 16/272,943, filed Feb. 11, 2019.
All Office Actions; U.S. Appl. No. 16/551,307, filed Aug. 26, 2019.
All Office Actions; U.S. Appl. No. 16/551,399, filed Aug. 26, 2019.
All Office Actions; U.S. Appl. No. 17/077,639, filed Oct. 22, 2020.
All Office Actions; U.S. Appl. No. 17/090,980, filed Jun. 11, 2020.
All Office Actions; U.S. Appl. No. 17/155,167, filed Jan. 22, 2021.
All Office Actions; U.S. Appl. No. 17/155,208, filed Jan. 22, 2021.
All Office Actions; U.S. Appl. No. 17/218,573, filed Mar. 31, 2021.
All Office Actions; U.S. Appl. No. 17/218,742, filed Mar. 31, 2021.
All Office Actions; U.S. Appl. No. 17/219,989, filed Apr. 1, 2021.
All Office Actions; U.S. Appl. No. 17/225,259, filed Apr. 8, 2021.
All Office Actions; U.S. Appl. No. 17/225,283, filed Apr. 8, 2021.
All Office Actions; U.S. Appl. No. 17/225,296, filed Apr. 8, 2021.
All Office Actions; U.S. Appl. No. 17/225,411, filed Apr. 8, 2021.
All Office Actions; U.S. Appl. No. 17/354,027, filed Jun. 22, 2021.
All Office Actions; U.S. Appl. No. 17/462,089, filed Aug. 31, 2021.
PCT Search Report and Written Opinion for PCTUS2020/024594 dated May 26, 2020.
Extended European Search Report and Search Opinion; Application Ser. No. 19166091.9; dated Sep. 12, 2019; 8 pages.
U.S. Appl. No. 17/462,089, filed Oct. 31, 2021, to first inventor et. al.

* cited by examiner

HEAD FOR AN ORAL CARE IMPLEMENT AND ORAL CARE IMPLEMENT

FIELD OF THE INVENTION

The present disclosure is concerned with a head for an oral care implement, the head comprising at least two tooth cleaning elements of a first type and a plurality of tooth cleaning elements of a second type. Each of the tooth cleaning elements of the first type is a tuft of a first type having a substantially rectangular or oval cross-sectional shape, said tufts being surrounded by the tooth cleaning elements of the second type. The present disclosure is further concerned with an oral care implement comprising such head.

BACKGROUND OF THE INVENTION

Tufts composed of a plurality of filaments for oral care implements, like manual and powered toothbrushes, are well known in the art. Generally, the tufts are attached to a bristle carrier of a head intended for insertion into a user's oral cavity. A grip handle is usually attached to the head, which handle is held by the user during brushing. The head is either permanently connected or repeatedly attachable to and detachable from the handle.

In order to clean teeth effectively, such brush heads comprise a plurality of tufts composed of a number of filaments, which tufts have usually a circular or slightly oval cross-sectional shape. However, such tufts have limited cleaning and paste foaming capabilities during brushing.

Additionally, standard tufts do not provide sufficient capillary effects to remove plaque and debris from the teeth and gum surfaces during brushing. However, in order to achieve good cleaning results, plaque must be reached by the tufts/filaments, then the plaque must be disrupted and, finally, taken away.

Further, toothbrushes are known having relatively large tuft dimensions. While toothbrushes comprising this type of tuft assembly may provide a relatively good foam formation and polishing effects during brushing, they may create an unpleasant brushing sensation when used with a scrubbing brushing technique, i.e. when performing a horizontal forth and back movement along the line of teeth. Such brushes are not adequate for users having sensitive gums.

Consequently, there exists a need for a toothbrush ensuring sufficient cleaning effects, while providing good sensory feeling on the gums during brushing.

It is an object of the present disclosure to provide a head for an oral care implement which overcomes at least one of the above-mentioned drawbacks. It is also an object of the present disclosure to provide an oral care implement comprising such head.

SUMMARY OF THE INVENTION

In accordance with one aspect, a head for an oral care implement is provided, the head having a longitudinal length extension extending between a proximal end and a distal end, an outer rim an inner portion, the head comprising at least two tooth cleaning elements of a first type and a plurality of tooth cleaning elements of a second type, the tooth cleaning elements of the first type being arranged at the inner portion of the head, and the plurality of tooth cleaning elements of the second type being arranged at the outer rim of the head, thereby surrounding the tooth cleaning elements of the first type, the tooth cleaning elements of the first type being tufts of a first type comprising a plurality of filaments, the tufts of the first type being arranged substantially parallel to each other, each tuft having a substantially rectangular or oval cross-sectional shape with a longer length extension from about 4 mm to about 8 mm and a shorter width extension from about 1.5 mm to about 2.5 mm, wherein the longer length extension defines an angle $\alpha$ with respect to the longitudinal length extension of the head of about 25° to about 60°.

In accordance with one aspect an oral care implement is provided that comprises such head, the head being preferably repeatedly attachable to and detachable from a handle.

BRIEF DESCRIPTION OF THE DRAWINGS

The invention is described in more detail below with reference to various embodiments and figures, wherein.

DETAILED DESCRIPTION OF THE INVENTION

Figure 1:
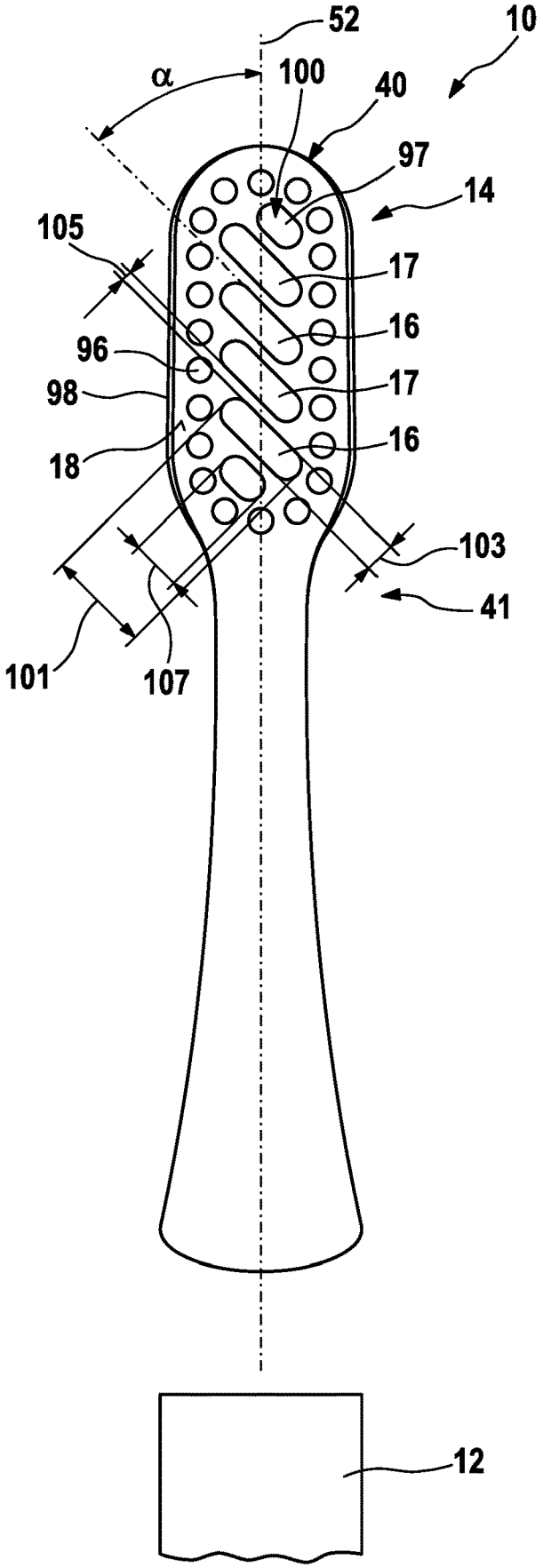
FIG. 1 shows a schematic top-down view of an example embodiment of an oral care implement comprising a head according to the present disclosure.

The head for an oral care implement has a longitudinal length extension extending between a proximal end and a distal end, the distal end being opposite the proximal end. The proximal end is defined as being the end closest to the handle. The handle may be permanently attached, or repeatedly attachable to and detachable from the handle. The head comprises an outer rim surrounding an inner portion. At least two tooth cleaning elements of a first type are arranged at the inner portion of the head. These tooth cleaning elements of the first type are tufts composed of filaments and are surrounded by a plurality of tooth cleaning elements of a second type which are arranged along the outer rim.

The tufts of the first type are arranged substantially parallel to each other. Each tuft extends from a mounting surface of the head in a substantially straight and perpendicular manner. The tufts have a length extension and a cross-sectional area extending substantially perpendicular to said length extension. The cross-sectional area has a rectangular or oval shape thereby defining a longer length extension from about 4 mm to about 8 mm and a shorter width extension from about 1.5 mm to about 2.5 mm. Alternatively, the length extension may be from about 5 mm to about 7 mm or from about 6 mm to about 7 mm or about 6.8 mm, and the width extension from about 2 mm. The longer length extension defines an angle $\alpha$ with respect to the longitudinal length extension of the head of about 25° to about 60°, or from about 30° to about 45°, or from about 30° to about 35°, or from about 40° to about 45°, or 35°, or 45°. The head may comprise at least three, preferably four tufts of the first type.

Consumer tests showed that such tuft pattern is perceived as very gentle in the mouth during brushing, while delivering improved cleaning performance as compared to regular brushes having a bristle pattern/structure being perceived as soft (so-called "sensitive brushes"). The brush according to the present disclosure is adapted to users suffering of gum sensitivity while delivering sufficient cleaning effects to deliver good oral health conditions in the mouth.

Sensitive brushes (i.e. brushes having relatively thin filaments or filaments comprising a tapered free ends) usually face the challenge to combine soft filaments with certain stability during use. Replacing standard filaments in a regular brush with softer filaments having smaller diameters delivers an overall softer brush, but as consumer often do not automatically apply less brushing force on a sensitive brush, the brush can easily collapse after a certain time of use. However, a "collapsed" brush—defined as a brush having filaments being significantly buckled—does not deliver desired cleaning performance.

In order to overcome this drawback, the head according to the present invention comprises first type tufts having a relatively large elongated, i.e. a substantially rectangular or oval, cross-sectional shape. Such first type tufts may be defined as "block tufts". The tufts of the first type are arranged in the middle or inner field/portion of the head, thereby allowing a higher filament density as compared to a regular brush being composed of a high number of single tufts with a relatively small diameter of about 1.5 mm to about 2.5 mm. In contrast to regular prior art brushes, a high filament density at the inner portion of the head according to the present disclosure allows for thorough polishing and paste foaming effects.

The filaments of the tufts of the first type may have a diameter of about 0.127 mm (5 mil). While relatively thin filaments (e.g. about 0.127 mm) are utilized, collapsing of the brush can be prevented if relatively high compression forces are applied onto the tuft during brushing as such forces can be absorbed and equally distributed by the high number of filaments of the tufts of the first type according to the present disclosure. The tufts of the first type are provided with increased stability in order to prevent said tuft from extensive splaying, while providing increased tooth cleaning efficiency. Brushes which look less used after brushing, in particular over a longer period of time, provide higher consumer acceptance.

The specific arrangement of the tufts of the first type (the longer length extension being oriented with respect to the length extension of the head by an angle $\alpha$ from about 25° to about 60°, or from about 30° to about 45°, or from about 30° to about 35°, or from about 40° to about 45°, or 35°, or 45°, and the tufts being arranged substantially parallel to each other), the tufts allow for a smooth gliding effect when the brush is moved in a forth and back scrubbing motion along the line of teeth. The diagonal orientation of the tufts of the first type and respective tuft overlap—when the brush is moved in a forth and back brushing motion—ensures that there is substantially no disruption in the brushing force and load uptake. With this arrangement a continuous gliding of the brush along the teeth can be assured. At the same time the continuous gliding delivers a gentle in-mouth perception. In contrast to a brush according to the present disclosure, a common tuft arrangement comprising a high number of individual tufts provides harsher in-mouth perception as individual tufts cause a peak in brushing force when the tufts jump from one tooth to the next one, thereby hitting the latter. The head according to the present disclosure does not only provide the before mentioned benefits when applying a scrubbing motion, but also for wipeout movements when the head is moved from the gums to the teeth.

While toothbrushes comprising conventional type of tufts clean the outer buccal face of teeth adequately, they are generally not as well suited to provide adequate removal of plaque and debris from the interproximal areas and other hard to reach regions of the mouth since penetration into interdental spaces is still relatively difficult. In particular, they are not well suited to sufficiently clean the gingival margin where typically plaque starts to grow. Thus, in order to achieve and preserve good oral health, and to prevent gingivitis, it is important to gently clean along the gum line and, in particular, the gap between teeth and periodontium, the so-called gingival groove without causing gum irritation or recession. It is known that a lack of good removal of plaque in the gingival groove can cause gingivitis, i.e. inflammation of the gum tissue.

To overcome these drawbacks, the tooth cleaning elements of the second type may be tufts of filaments, each tuft having a substantially circular cross-sectional area with a diameter from about 1.5 mm to about 2 mm, or about 1.6 mm. To further maximize gentle in-mouth perception and gentle cleaning effects, the filaments of the tufts of the second type may be tapered filaments, said filaments being in contact with the relatively sensitive gumline during brushing. The filaments of the tufts of the second type may be longer than the filaments of the tufts of the first type, thereby further improving reach into the gingival groove.

Alternatively, the tooth cleaning elements of the second type can also be elastomeric cleaning elements. The elastomeric elements can be made of TPE material, and/or may have the shape of an elastomeric wall extending along the length extension of the head. Such elastomeric wall may provide a polishing effect on the outer tooth surfaces and may remove tooth coloration more completely. Alternatively, the elastomeric element may have the shape of a rubber nub or finger for stimulating and massaging the gums.

To even further maximize cleaning performance and gentle in-mouth perception, the head may comprise at least one tuft of the first type, wherein the tuft is composed of cross-shaped filaments, while at least another tuft of the first type may comprise cylindrical filaments having a relatively small diameter, e.g. about 0.127 mm (5 mil). The cross-shaped filaments may be combined with soft round filaments thereby enhancing the cleaning performance by means of the cross-shaped filaments, while providing a certain density to the bristle field by using relatively thin circular filaments. In other words, the at least one tuft of the first type comprising filaments having a cross-shaped cross-sectional area, or a plurality of said tufts, may be arranged in an alternating manner with at least one tuft or a plurality of tufts of the first type comprising filaments having a substantially circular cross-sectional shape.

Cross-shaped filaments are defined as filaments having a longitudinal axis and a substantially cross-shaped cross-sectional area extending in a plane substantially perpendicular to the longitudinal axis. The cross-shaped cross-sectional area has four projections and four channels being arranged in an alternating manner. The longitudinal axis of a filament is defined by the main extension of the filament. In the following, the extension of the filament along its longitudinal axis may also be referred to as the "longitudinal extension of the filament".

The filaments of the at least one tuft of the first type comprising cross-shaped filaments may be provided with a lower packing factor within a range from about 40% to about 55%, or within a range from about 45% to about 50%. In the context of this disclosure the term "packing factor" is defined as the sum total of the transverse cross-sectional areas of the filaments in the tuft hole divided by the transverse cross-sectional area of the tuft hole. In embodiments where anchors, such as staples, are used to mount the tuft within the tuft hole, the area of the anchoring means is excluded from the transverse cross-sectional area of the tuft hole.

A packing factor of about 40% to about 55%, or from about 45% to about 50%, or about 49% may open up a specific void volume within the tuft while the filaments have still contact to each other along a portion of the outer lateral surface. The void volume may deliver more toothpaste to the tooth brushing process, and the toothpaste can interact with the teeth for a longer period of time which contributes to improved tooth brushing effects. In addition, the void volume, i.e. the space between filaments, enables increased uptake of loosened plaque due to improved capillary action. In other words, such low packing factor may result in more dentifrice/toothpaste retaining at/adhering to the filaments for a longer period of time during a tooth brushing process. Further, the lower tuft density may avoid that the dentifrice spread away which may result in an improved overall brushing process. Toothpaste can be better received in the cannels and, upon cleaning contact with the teeth, directly delivered, whereby a greater polishing effect is achieved, which is desirable, in particular for removal of tooth discoloration. However, at the same time due to the large cross-sectional area of the overall tuft, a higher number of filaments are provided within a tuft enabling improved brushing force and load uptake thereby reducing tuft splay.

In other words, a relatively low packing factor within a range from about 40% to about 55%, or from about 45% to about 50%, or about 49% may provide improved brushing effectiveness, i.e. better removal of plaque and debris from the teeth's surface and gums due to improved capillary effects. These capillary effects may enable the dentifrice to flow towards the tip/free end of the filaments and, thus, may make the dentifrice more available to the teeth and gums during brushing. At the same time uptake of plaque and debris away from the teeth and gum surfaces is improved.

Further, due to the cross-shaped geometry of the filament, each single filament is stiffer than a circular-shaped filament, when made of the same amount of material. However, due to the low packing factor within a range from about 40% to about 55%, or from about 45% to about 50%, or about 49%, the stiffness of the overall tuft made of cross-shaped filaments is reduced as compared to a tuft of circular-shaped filaments. Surprisingly, it has been found out that such tuft provides improved sensory experience, i.e. a softer feeling within the mouth during brushing, while providing increased cleaning efficiency. The projections of the cross-shaped filaments can easily enter the gingival groove and other hard to reach areas, e.g. interproximal tooth surfaces, scratch on the surfaces to loosen the plaque, and due to the improved capillary effects of the overall tuft, the plaque can be better taken away. Due to the special shape, cross-shaped filaments can penetrate deeper into the gingival groove and interproximal areas. In addition, the relatively low packing factor of the tuft of the first type enables the individual cross-shaped filaments to better adapt to the contour of the gum line and gingival grove.

Tests have shown that heads for oral care implements comprising cross-shaped filaments according to the present disclosure provide superior cleaning performance (cf. FIGS. 7 to 9 and 11 along with the description below).

Further, a test simulating wear during consumer usage showed that such brush heads additionally show less wear as compared to heads comprising tufts of cross-shaped filaments, only. The test set-up for simulating "wear" was as follows: Brushes ran a program that accomplishes totally 36.000 brushing cycles, 9.000 cycles each at 0°, +45°, −45° and 0° angle between the brush head and a row of teeth. During these cycles a solution of 7.5% Blend a Med toothpaste dripped on the brush head. The load on the brush head was set to 4N. The first 9.000 cycles at 0° angle were defined as a movement along a straight line with a length of 30 mm, while the next three 9.000 cycles at +45°, −45° and 0° angle were defined as a movement along an "eight" with a width of 22 mm and a length of 40 mm. The maximum penetration depth of the filaments into the row of teeth was set to 7 mm.

Each channel of the cross-shaped filaments of the at least one tuft of the first type may have a concave curvature formed by neighboring and converging projections. Said concave curvature may have a radius within a range from about 0.025 mm to about 0.10 mm, or from about 0.03 mm to about 0.08 mm, or from about 0.04 mm to about 0.06 mm. In other words, two neighboring projections, i.e. two neighboring side lateral edges of said projections may converge at the bottom of a channel and define a "converging region". The neighboring projections may converge in said converging region in a manner that a concave curvature, i.e. with an inwardly curved radius is formed at the bottom of the channel A radius within such range is relatively large as compared to standard cross-shaped filaments (cf. FIG. 3 and as further described below).

Figure 5:
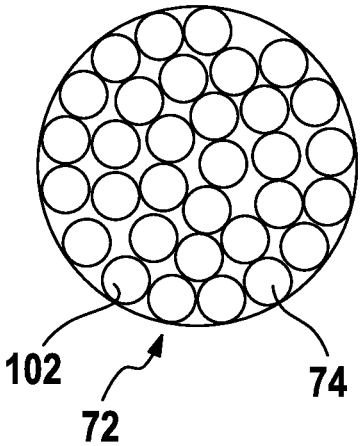
FIG. 5 shows a schematic cross-sectional view of a tuft according to a first comparative example embodiment.

In the past it has been observed that conventional cross-shaped filaments (e.g. as shown in FIG. 5 and further described below) have the disadvantage that these type of filaments can easily catch amongst themselves, both during manufacturing and brushing. However, it has been surprisingly found out that the specific geometry/contour of the outer surface of the filament according to the present disclosure allows for improved manufacturability since there is significant less likelihood that the filaments get caught when a plurality of said filaments is combined to form one tuft during a so-called "picking process".

Further, due to the relatively large radius at the bottom of the channel, the filament is provided with increased stability, and, thus, less filament damage occur during the brush manufacturing process, e.g. when the filaments get picked and fixed on the mounting surface of the brush head during a stapling or hot tufting process. In the past, it has been observed that a relatively high number of conventional cross-shaped filaments get damaged during the picking process, in particular projections may break away from the filament, or the filament gets spliced in the converging region at the bottom of a channel. Spliced filaments can provide relatively sharp edges which may harm/injure the oral tissue during brushing.

Further, surprisingly it has been found out that due to the specific geometry of the radius of the concave curvature, the filaments within a tuft can be better packed with a relatively low packing factor, i.e. within a range from about 40% to about 55%, or within a range from about 45% to about 50%, as gaps between two adjacent filaments can be maximized. It has been found out that it is important that the filaments open up a specific void area while still having contact to each other. In order to produce a toothbrush that is compliant with regulatory requirements and appreciated by the consumer regarding the overall appearance, typically a high packing factor (about 70% to about 80% for round filaments; about 80% for diamond-shaped filaments; about 89% for trilobal filaments) is needed. With respect to toothbrushes manufactured by a stapling process, a packing factor lower than about 70% results in insufficiently compressed filaments within the tuft hole and, thus, provides insufficient tuft retention. Consequently, regulatory requirements are not met in case round filaments are provided with a packing factor lower than about 70%. For hot tufted toothbrushes, a packing factor lower than about 70% would allow plastic melt entering into the tuft during the over molding process as the pressure of the melt pushes the filaments of the tuft to one side until the filaments have contact to each other. So-called polyspikes are thereby formed which may injure/harm the gums and, thus resulting in unsafe products. Beside regulatory and safety aspects a low packed tuft of round filaments would have a "wild" and destroyed appearance and would not be accepted by consumers. However, with the usage of cross-shaped filaments having a radius of the concave curvature of the channel within a range from about 0.025 mm to about 0.10 mm a low packing factor can be achieved for compliant and safe products having an acceptable overall appearance while providing improved cleaning properties.

Figure 7:
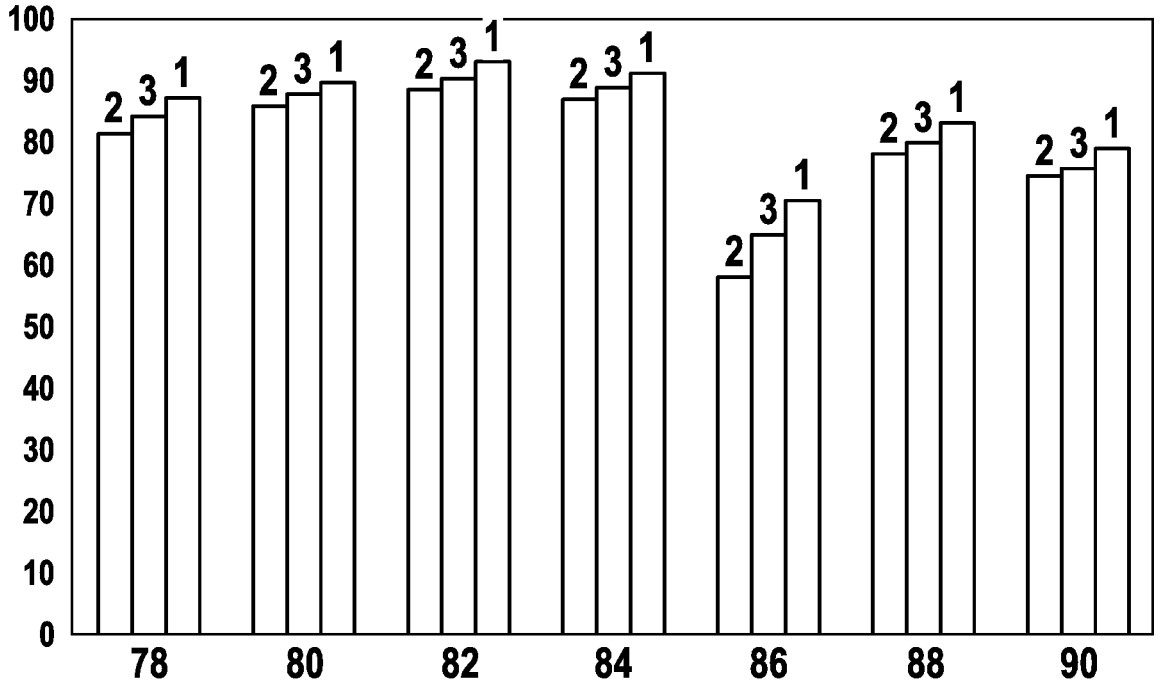
FIG. 7 shows a diagram in which brushing results of a tuft comprising cross-shaped filaments according to the present disclosure are compared with brushing results of tufts according to two comparative example embodiments.

Each projection of the cross-shaped cross-sectional area comprises two outer lateral edges along the filament's longitudinal extension. These lateral edges may generate relatively high concentrated stress on the tooth surfaces to disrupt and remove plaque. The outer edges can provide a scraping effect so that plaque and other debris get loosened more effectively. Due to the relatively large radius of the concave curvature at the bottom of the channel, the projections are provided with increased stiffness/stability to loosen/remove plaque from the teeth surfaces more easily/effectively. The channels can then capture the disrupted plaque and may move it away from the teeth. As shown in FIG. 7 and further explained below, a tuft comprising a plurality of filaments according to the present disclosure provides improved plaque removal from the buccal, lingual, occlusal and interdental surfaces as well as along the gum line as compared to a tuft of circular or conventional cross-shaped filaments.

The cross-shaped cross-sectional area of each filament of the tufts of the first type may have an outer diameter. In the context of the present disclosure the outer diameter is defined by the length of a straight line that passes through the center of the filament's cross-sectional area and whose endpoints lie on the most outer circumference of the cross-sectional area. In other words, the cross-shaped cross-sectional area has an imaginary outer circumference in the form of a circle (i.e. outer envelope circle), and the outer diameter is defined as the longest straight line segment of the circle passing through the center of the circle.

The outer diameter may be within a range from about 0.15 mm to about 0.40 mm, or from about 0.19 mm to about 0.38 mm, or the outer diameter may be within a range from about 0.22 mm to about 0.35 mm, or from about 0.24 mm to about 0.31 mm.

The ratio of the outer diameter to the radius of the curvature of the channel may be within a range from about 2.5 to about 12. Alternatively, the ratio of the outer diameter to the radius of the curvature of the channel may be within a range from about 2.7 to about 9.

Surprisingly, it has been found out that such filament geometry provides even further improved cleaning performance while maintaining brush comfort in the mouth. In addition, it has been found out that such geometry helps even more to reduce the appearance of filament/tuft wear since there is even less likelihood that the filaments get caught during brushing. Further, the manufacturability of such filaments during a toothbrush manufacturing process is further improved.

Each projection of the cross-shaped cross-sectional area of the filaments of the tufts of the first type may be end-rounded thereby forming a curvature. Said curvature may have a diameter. The diameter of the curvature of the projection may be within a range from about 0.01 mm to about 0.04 mm, or within a range from about 0.018 mm to about 0.026 mm.

The ratio of the diameter of the curvature of the projection to the radius of the curvature of the channel may be within a range from about 0.2 to about 1.5, or from about 0.3 to about 1.0, or from about 0.5 to about 0.7. Said ratio is relatively low as compared to standard cross-shaped filaments according to the state of the art (cf. FIG. 3 and as further described below). In other words, the radius of the concave curvature of the channel is relatively large with respect to the diameter of the curvature of the projection, i.e. with respect to the width extension of the projection—or in other words, the diameter of the curvature of the projection can be relatively thin as compared to the radius of the concave curvature of the channel. The relatively large radius provides the relatively thin projections with increased stability. Thus, there is less likelihood that the filaments/projections get damaged or that the relatively thin projections break away during the brush manufacturing process, in particular when the filaments get picked. In other words, the manufacturability of such filaments during a toothbrush manufacturing process is further improved.

Further, surprisingly, it has been found out that such filament geometry provides even further improved cleaning performance while maintaining brush comfort in the mouth. In addition, it has been found out that such geometry further helps to reduce the appearance of filament/tuft wear since there is even less likelihood that the filaments get caught during brushing.

The diameter of the curvature of the projection may be within a range from about 6% to about 15% or from about 8% to about 12% of the outer diameter of the filament. Surprisingly, it has been found out that such filaments may adapt to the teeth contour even better and penetrate into the interdental spaces more easily to remove plaque and debris more completely.

The projections of the cross-shaped filament may taper radially off in an outward direction, i.e. in a direction away from the center of the cross-sectional area and towards the outer circumference. Such tapered projections may further assure access to narrow spaces and other hard to reach areas and may be able to penetrate into/enter interdental areas even more deeply and effectively. Since the bending stiffness of a cross-shaped filament is higher as compared to a circular-shaped filament made of the same amount of material, the higher bending stiffness may force the filament's projections to slide into the interdental areas more easily.

The projections may taper radially outwards by an angle within a range from about 6° to about 25°, or by an angle within a range from about 8° to about 20°. Surprisingly, it has been found out that such tapering allows for optimal interdental penetration properties. Additionally, such filament can be more easily bundled in a tuft without catching on contours of adjacent filaments.

The filaments of the tufts of the first type may be a substantially cylindrical filament, i.e. the filament may have a substantially cylindrical outer lateral surface. In other words, the shape and size of the cross-sectional area of the filament along its longitudinal axis may not vary substantially, i.e. the shape and size of the cross-sectional area may be substantially constant over the longitudinal extension of the filament. In the context of this disclosure the term "outer lateral surface of a filament" means any outer face or surface of the filament on its sides. This type of filament may provide increased bending stiffness as compared to tapered filaments. A higher bending stiffness may further facilitate the filament to penetrate into interdental gaps/spaces. Further, cylindrical filaments are generally slowly worn away which may provide longer lifetime of the filaments.

The cylindrical filament may have a substantially end-rounded tip/free end to provide gentle cleaning properties. End-rounded tips may avoid that gums get injured during brushing. Within the context of this disclosure, end-rounded filaments would still fall under the definition of a substantially cylindrical filament.

Alternatively, the filaments of the tuft of the first type may comprise along its longitudinal axis a substantially cylindrical portion and a tapered portion, the tapered portion tapers in the longitudinal direction towards a free end of the filament, and the cylindrical portion has a cross-sectional area according to the present disclosure. In other words, the filaments of the tuft of the first type may be tapered filaments having a pointed tip. Tapered filaments may achieve optimal penetration into areas between two teeth as well as into gingival pockets during brushing and, thus, may provide improved cleaning properties. The tapered filaments may have an overall length extending above the mounting surface of the head within a range from about 8 mm to about 16 mm, optionally about 12.5 mm, and a tapered portion within a range from about 5 mm to about 10 mm measured from the tip of the filament. The pointed tip may be needle shaped, may comprise a split or a feathered end. The tapering portion may be produced by a chemical and/or mechanical tapering process.

The filaments of the tufts of the first and/or second type may be made of polyamide, e.g. nylon, with or without an abrasive such as kaolin clay, polybutylene terephthalate (PBT) with or without an abrasive such as kaolin clay and/or of polyamide indicator material, e.g. nylon indicator material, colored at the outer surface. The coloring on the polyamide indicator material may be slowly worn away as the filament is used over time to indicate the extent to which the filament is worn.

The filaments of the tufts of the first and/or second type may comprise at least two segments of different materials. At least one segment may comprise a thermoplastic elastomer material (TPE) and at least one segment may comprise polyamide, e.g. nylon, with or without an abrasive such as kaolin clay, polybutylene terephthalate (PBT) with or without an abrasive such as kaolin clay or a polyamide indicator material, e.g. a nylon indicator material, colored at the outer surface. These at least two segments may be arranged in a side-by-side structure or in a core-sheath structure which may result in reduced stiffness of the overall filament. A core-sheath structure with an inner/core segment comprising a harder material, e.g. polyamide or PBT, and with an outer/sheath segment surrounding the core segment and comprising a softer material, e.g. TPE, may provide the filament with a relatively soft outer lateral surface which may result in gentle cleaning properties.

The filaments of the tufts of the first and/or second type may comprise a component selected from fluoride, zinc, strontium salts, flavor, silica, pyrophosphate, hydrogen peroxide, potassium nitrate or combinations thereof. For example, fluoride may provide a mineralization effect and, thus, may prevent tooth decay. Zinc may strengthen the immune system of the user. Hydrogen peroxide may bleach/whiten the teeth. Silica may have an abrasive effect to remove dental plaque and debris more effectively. Pyrophosphate may inhibit the formation of new plaque, tartar and dental calculus along the gum line. A filaments comprising pyrophosphate may offer lasting protection against inflammations of the gums and mucous membrane of the mouth.

If a plurality of such filaments is bundled together to form a tuft, they may be arranged in a manner that filaments at the tuft's outer lateral surface may comprise pyrophosphate to inhibit the formation of plaque, tartar and dental calculus along the gum line whereas filaments arranged in the center of the tuft may comprise fluoride to mineralize the teeth during a brushing process.

At least one of the components listed above may be coated onto a sheath, i.e. onto an outer segment of a filament. In other words, at least some of the filaments of the tuft may comprise a core-sheath structure wherein the inner/core segment may comprise TPE, polyamide or PBT, and the outer/sheath segment may comprise at least one of the components listed above. Such core-sheath structure may make the component(s) directly available to the teeth in a relatively high concentration, i.e. the component(s) may be in direct contact with the teeth during brushing.

Alternatively, at least one of the components listed above may be co-extruded with TPE, polyamide, e.g. nylon, and/or PBT. Such embodiments may make the component(s) gradually available to the teeth when the filament material is slowly worn away during use.

The oral care implement according to the present disclosure may be a toothbrush comprising a handle and a head. The head extends from the handle and may be either repeatedly attachable to and detachable from the handle, or the head may be non-detachably connected to the handle. The toothbrush may be an electrical or a manual toothbrush.

A head for an oral care implement in accordance with the present disclosure may comprise a bristle carrier being provided with tuft holes, e.g. blind-end bores. Tufts according to the present disclosure may be fixed/anchored in said tuft holes by a stapling process/anchor tufting method. This means, that the filaments of the tufts are bent/folded around an anchor, e.g. an anchor wire or anchor plate, for example made of metal, in a substantially U-shaped manner. The filaments together with the anchor are pushed into the tuft hole so that the anchor penetrates into opposing side walls of the tuft hole thereby anchoring/fixing/fastening the filaments to the bristle carrier. The anchor may be fixed in opposing side walls by positive and frictional engagement.

In case the tuft hole is a blind-end bore, the anchor holds the filaments against a bottom of the bore. In other words, the anchor may lie over the U-shaped bend in a substantially perpendicular manner Since the filaments of the tuft are bent around the anchor in a substantially U-shaped configuration, a first limb and a second limb of each filament extend from the bristle carrier in a filament direction. Filament types which can be used/are suitable for usage in a stapling process are also called "two-sided filaments". Heads for oral care implements which are manufactured by a stapling process can be provided in a relatively low-cost and time-efficient manner. To enable provision of tufts of the first type comprising a relatively large cross-sectional area, a plurality of smaller tuft holes can be placed with minimal spacing in close proximity to each other so that a larger overall tuft can be formed.

Alternatively, the tufts may be attached/secured to the head by means of a hot tufting process. One method of manufacturing the head of an oral care implement may comprise the following steps: Firstly, the tufts may be formed by providing a desired amount of filaments according to the present disclosure. Secondly, the tufts may be placed into a mold cavity so that ends of the filaments which are supposed to be attached to the head extend into said cavity. Thirdly, the head or an oral care implement body comprising the head and the handle may be formed around the ends of the filaments extending into the mold cavity by an injection molding process, thereby anchoring the tufts in the head. Alternatively, the tufts may be anchored by forming a first part of the head—a so called "sealplate"—around the ends of the filaments extending into the mold cavity by an injection molding process before the remaining part of the oral care implement may be formed. Before starting the injection molding process, the ends of the at least one tuft extending into the mold cavity may be optionally melted or fusion-bonded to join the filaments together in a fused mass or ball so that the fused masses or balls are located within the cavity. The tufts may be held in the mold cavity by a mold bar having blind holes that correspond to the desired position of the tuft on the finished head of the oral care implement. In other words, the filaments of the tufts attached to the head by means of a hot tufting process may be not doubled over a middle portion along their length and may be not mounted in the head by using an anchor/staple. The tufts may be mounted on the head by means of an anchor-free tufting process. A hot tufting manufacturing process allows for complex tuft geometries. For example, the tufts may have a specific topography/geometry at its free end, i.e. at its upper top surface, which may be shaped to optimally adapt to the teeth's contour and to further enhance interdental penetration. For example, the topography may be chamfered or rounded in one or two directions, pointed or may be formed linear, concave or convex.

The following is a non-limiting discussion of example embodiments of oral care implements and parts thereof in accordance with the present disclosure, where reference to the Figures is made.

FIG. 1 shows a schematic top-down view of an example embodiment of an oral care implement 10 which could be a manual or an electrical toothbrush 10 comprising a handle 12 and a head 14 extending from the handle 12 in a longitudinal direction. The head 14 has a proximal end 41 close to the handle 12 and a distal end 40 furthest away from the handle 12, i.e. opposite the proximal end 41. The head 14 may have substantially the shape of an oval with a longitudinal length extension 52 and a width extension substantially perpendicular to the length extension 52. Two tufts of the first type 16 comprising a plurality of cross-shaped filaments 20, and two tufts of the first type 17 comprising a plurality of circular-shaped filaments having a diameter of about 0.127 mm (5 mil) are arranged in an alternating manner at an inner portion 100 of the head 14.

The tufts of the first type 16, 17 are arranged substantially parallel to each other. Each tuft 16, 17 has a substantially rectangular or oval cross-sectional shape with a longer length extension 101 from about 6.5 mm to about 7 mm and a shorter width extension 103 from about 1.8 mm to about 2.2 mm, wherein the longer length extension 101 defines an angle $\alpha$ with respect to the longitudinal length extension 52 of the head 14 of about 30° to about 45°. Spacing 105 between parallel tufts 16, 17 may be about 0.5 to about 0.8 mm to enable smooth gliding effects from one tuft to the other during brushing. Two further elongated tufts 97 are neighboring tufts 16, 17 at the distal and proximal ends 40,42 of the head 14, respectively. Tufts 97 have a substantially rectangular or oval cross-sectional shape with a longer length extension 107 of about 3 mm to about 3.5 mm.

At an outer rim 98 of the head 14 there are arranged a plurality of tooth cleaning elements of a second type 96, thereby surrounding the tooth cleaning elements of the first type 16, 17 and tufts 97. The plurality of tufts of the second type 96 comprise a plurality of tapered filaments having a diameter of about 0.127 mm (5 mil) or 0.1524 (6 mil).

All tufts 16, 17, 96, 97 may extend from a mounting surface 18 of the head 14 in a substantially orthogonal manner.

The tufts of the first type 16 may have a packing factor within a range from about 40% to about 55%, or from about 45% to about 50%, or about 49%. The "packing factor" is defined as the total sum of the cross-sectional areas 22 of the filaments 20 divided by the cross-sectional area of the tuft hole.

Figure 2:
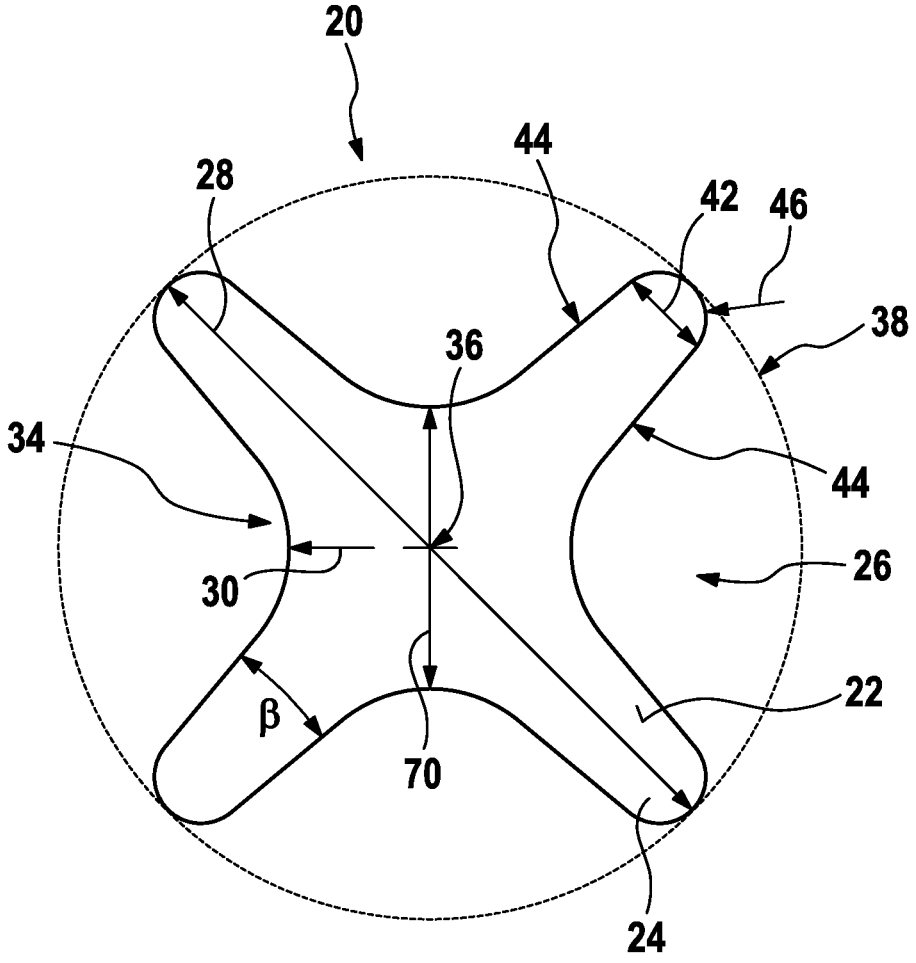
FIG. 2 shows a schematic cross-sectional view of one filament of the tuft of the first type as shown in FIG. 1.

The tufts of the first type 16 as illustrated in FIG. 1 comprise a plurality of end-rounded cross-shaped filaments 20, one of them being shown in FIG. 2. Alternatively, the filaments 20 may be tapered filaments comprising along the longitudinal axis a substantially cylindrical portion and a tapered portion. The tapered portion tapers towards the free end of the filament 20, and the cylindrical portion has a cross-sectional area 22 according to the present disclosure.

FIG. 2 shows a schematic cross-sectional view of a filament 20 of tuft 16. The filament 20 has a longitudinal axis and a substantially cross-shaped cross-sectional area 22 extending in a plane substantially perpendicular to the longitudinal axis. The cross-shaped cross-sectional area 22 has four projections 24 and four channels 26. The projections 24 and channels 26 are arranged in an alternating manner. Each projection 24 tapers in an outward direction by an angle $\beta$ within a range from about 6° to about 25°, or from about 8° to about 20°.

The cross-sectional area 22 has an outer diameter 28 passing through the center 36 of the filament's cross-sectional area 22. The endpoints of the outer diameter 28 lie on the most outer circumference 38 of the cross-sectional area 22. The outer diameter 28 has a length extension within a range from about 0.15 mm to about 0.40 mm, from about 0.19 mm to about 0.38 mm, from about 0.22 mm to about 0.35 mm, or from about 0.24 mm to about 0.31 mm.

Each channel 26 has a concave curvature 34, i.e. a curvature being curved inwardly towards the center 36 of the cross-sectional area 22. The concave curvature 34 is formed at the bottom of each channel 26 by two neighboring and converging projections 24. The concave curvature 34 has a radius 30 which is in a range from about 0.025 mm to about 0.10 mm, or from about 0.03 mm to about 0.08 mm, or from about 0.04 mm to about 0.06 mm.

The ratio of the outer diameter 28 to the radius 30 of the concave curvature 34 is within a range from about 2.5 to about 12, or from about 2.7 to about 9.

Each projection 24 is end-rounded thereby forming a curvature with a specific diameter 42. Said diameter 42 can also be defined as the width extension 42 extending between two opposite lateral edges 44 of the projection 24. The ratio of the diameter 42 of the curvature of the projection 24 to the radius 30 of the curvature 34 of the channel 26 is within a range from about 0.2 to about 1.5, or from about 0.3 to about 1.0, or from about 0.5 to about 0.7.

Further, the diameter 42 of the end-rounding of the projection 24 is defined in a range from about 6% to about 15%, or from about 8% to about 12% of the outer diameter 28 of the filament 20. For example, the diameter 42 of the end-rounding of the projection 24 may be within a range from about 0.01 mm to about 0.04 mm, or within a range from about 0.018 mm to about 0.026 mm.

Figure 3:
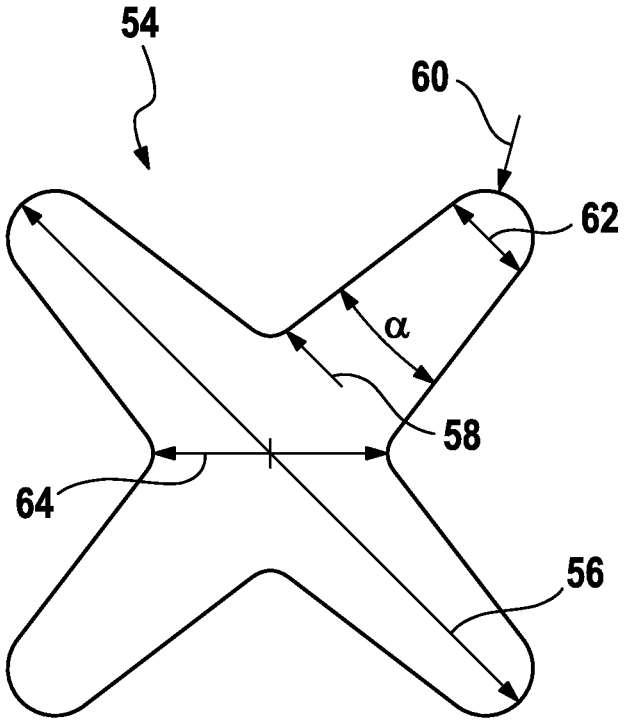
FIG. 3 shows a schematic cross-sectional view of a filament according to the state of the art.

FIG. 3 shows a schematic cross-sectional view of a cross-shaped filament 54 according to the state of the art. Filament 54 comprises the following dimensions:

Outer diameter 56: 0.295 mm.

Radius 58 of the concave curvature of the channel: 0.01 mm.

Ratio outer diameter 56 to radius 58 of the concave curvature: 29.5

Tapering of the projections α: 15°

Diameter 62 of the curvature of the projection: 0.04 mm

Ratio of the diameter 62 to the radius 58: 4

Inner diameter 64: 0.1 mm.

Figure 4:
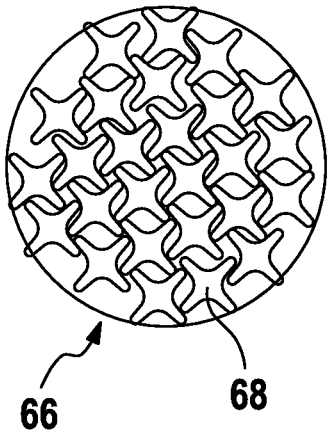
FIG. 4 shows a schematic cross-sectional view of a tuft comprising cross-shaped filaments according to the present disclosure.

FIG. 4 shows a schematic cross-sectional view of a tuft 66 having cross-shaped filaments 68 according to the present disclosure (example embodiment 1). Tuft 66 has a packing factor of about 49%. The filaments 68 of tuft 66 have the following dimensions:

Outer diameter 28: 0.309 mm

Radius 30 of the concave curvature: 0.06 mm

Ratio outer diameter 28 to radius 30 of the concave curvature: 5.15

Tapering of the projections α: 10°

Diameter 42 of the curvature of the projection 42: 0.04 mm

Ratio of the diameter 42 to the radius 30: 0.67

Inner diameter 70: 0.12 mm.

FIG. 5 shows a schematic cross-sectional view of a tuft 72 comprising a plurality of circular filaments 74 according to the state of the art. The diameter of filaments 74 is about 0.178 mm (7 mil). Such tuft 72 has a packing factor of about 77% (comparative example 2).

Figure 6:
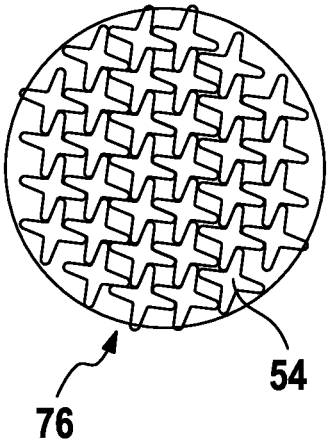
FIG. 6 shows a schematic cross-sectional view of a tuft according to a second comparative example embodiment.

FIG. 6 shows a schematic cross-sectional view of a tuft 76 comprising a plurality of filaments 54 according to FIG. 3. Such tuft 76 has a packing factor of about 58% (comparative example 3).

COMPARISON EXPERIMENTS

Robot Tests:

Tuft 66 (diameter of the tuft: 1.7 mm) in accordance with FIG. 4 comprising a plurality of filaments 68 (example embodiment 1), the tuft 72 (diameter of the tuft: 1.7 mm) according to FIG. 5 comprising a plurality of filaments 74 (comparative example 2), and the tuft 76 (diameter of the tuft: 1.7 mm) according to FIG. 6 comprising a plurality of filaments 54 (comparative example 3) were compared with respect to their efficiency of plaque substitute removal on artificial teeth (typodonts).

Brushing tests were performed using a robot system KUKA 3 under the following conditions (cf. Table 1):

TABLE 1

| Product | program upper jaw | program lower jaw | force | power supply |
|---|---|---|---|---|
| All tested products | EO_INDI | EU_INDI | 3 N | no |
| total cleaning time | 60 s | 60 s | | |
| program version | 9.11.09 Eng | 9.11.09 Eng | | |
| SYSTEC speed | 60 | 60 | | |
| SYSTEC amplitude x/y | 20/0 | 20/0 | | |
| number of moves | 3 | 3 | | |
| Movement | | horizontal | | |
| used handle/mould | | No/no | | |

FIG. 7 shows the amount of plaque substitute removal in % of example embodiment 1, comparative example 2 and comparative example 3, each with respect to all tooth surfaces 78, buccal surfaces 80, lingual surfaces 82, lingual and buccal surfaces 84, occlusal surfaces 86, the gum line 88 and interdental surfaces 90.

FIG. 7 clearly shows that example embodiment 1 provides significant improved plaque removal properties with respect all tooth surfaces 78, buccal surfaces 80, lingual surfaces 82, lingual and buccal surfaces 84, occlusal surfaces 86, the gum line 88 and interdental surfaces 90 as compared to comparative examples 2 and 3. The most significant improvement of the cleaning performance occurred on the occlusal surfaces 86 with an improvement of 22% and 9%, respectively.

Figure 8:
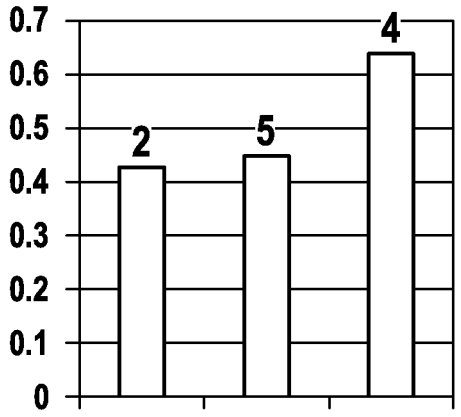
FIG. 8 shows a diagram in which "slurry uptake mass" of a tuft comprising cross-shaped filaments according to the present disclosure is compared with "slurry uptake mass" of tufts according to two comparative example embodiments.
Figure 10:
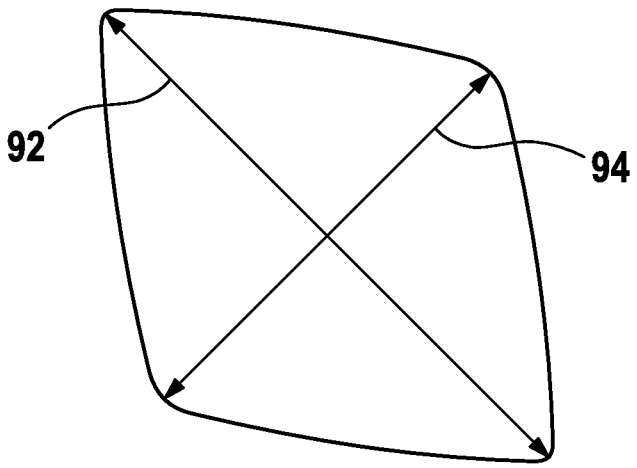
FIG. 10 shows a schematic cross-sectional view of a diamond-shaped filament according to the state of the art.

Slurry Uptake Tests:

FIG. 8 shows a diagram in which "slurry uptake mass" of a tuft comprising cross-shaped filaments according to the present disclosure, the tuft having a packing factor of about 46% (example embodiment 4) is compared with "slurry uptake mass" of a tuft comprising diamond shaped filaments (cf. FIG. 10) and having a packing factor of about 80% (comparative example 5), and with "slurry uptake mass" of the tuft 72 having a packing factor of about 77% according to comparative example 2.

The filaments of example embodiment 4 have the following dimensions:

Outer diameter: 0.269 mm

Radius of the concave curvature of the channel: 0.05 mm

Ratio of outer diameter to radius of the concave curvature: 5.38

Tapering of the projections α: 14°

Diameter of the curvature of the projection: 0.029 mm

Ratio of the diameter of the curvature of the projection to the radius concave curvature of the channel: 0.58

Inner diameter: 0.102 mm

The filaments of comparative example 5 have the following dimensions (cf. FIG. 12):

Longer diagonal length 92: 0.29 mm

Shorter diagonal length 94: 0.214 mm

Figure 9:
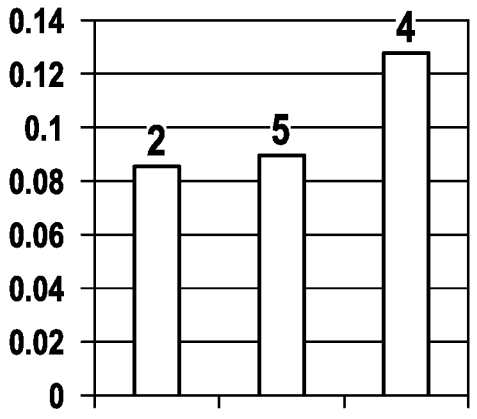
FIG. 9 shows a diagram in which "slurry uptake speed" of a tuft comprising cross-shaped filaments according to the present disclosure is compared with "slurry uptake speed" of tufts according to two comparative example embodiments.

FIG. 9 shows a diagram in which "slurry uptake speed" of example embodiment 4 is compared with "slurry uptake speed" of comparative examples 2 and 5.

Test Description:

Brush heads comprising tufts according to example embodiment 4 and comparative examples 2 and 5 were fixed in a horizontal position with filaments pointing down. A bowl of toothpaste slurry (toothpaste:water=1:3) was placed with a scale directly under the brush heads. The scale was used to measure the amount of slurry in the bowl. When the test was started, the brushes moved down with 100 mm/s and dipped 2 mm deep into the slurry. Then the brushes were hold for 5 s in the toothpaste slurry and pulled out again with 100 mm/min. The force in vertical direction was measured over time.

FIGS. 8 and 9 clearly show that example embodiment 4 provides significant improved "slurry uptake" in terms of mass and speed as compared to comparative examples 2 and 5. The increased void volume within the tuft of example embodiment 4 enables improved capillary action. This leads to increased uptake of toothpaste (slurry) so that the toothpaste interacts/contributes longer to the tooth brushing process. The tuft of example embodiment 4 can take-up about 50% more toothpaste slurry with about 50% higher uptake speed which results in improved tooth cleaning effects. In other words, besides delivering more toothpaste to the tooth brushing process, the specific void volume within the tuft of example embodiment 4 enables also increased uptake of loosened plaque. This results in an overall improved clinical performance of a toothbrush comprising a head with a tuft configuration according to the present disclosure.

Figure 11:
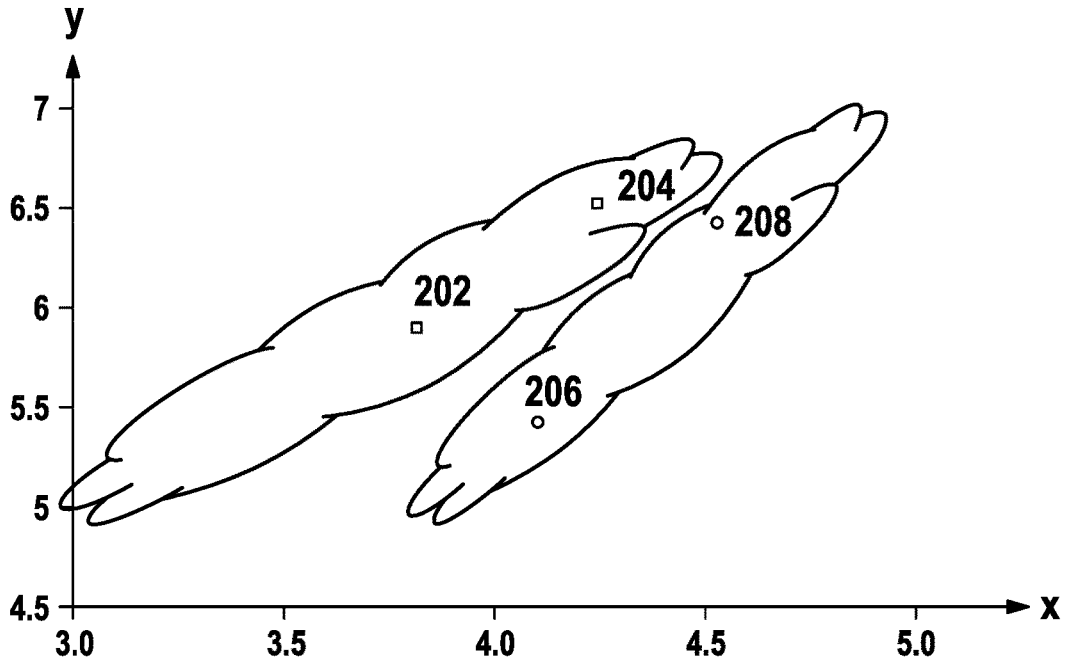
FIG. 11 shows a diagram in which gum massaging effects of cross-shaped filaments according to the present disclosure are compared with gum massaging effects of circular-shaped filaments of a head.

FIG. 11 shows a diagram in which "perceived gum massaging" properties of cross-shaped filaments are compared with "perceived gum massaging" properties of circular filaments. As shown in the diagram brush heads 202, 204 comprising cross-shaped filaments having lower stiffness ($cN/mm^2$) (x-axis) achieve a higher level of gum massage intensity (y-axis) as compared to brush heads 206, 208 having circular filaments. In other words, brush heads 202, 204 provide improved gum massage/sensory feeling due to the specific structure of the cross-shaped filaments.

Figure 12:
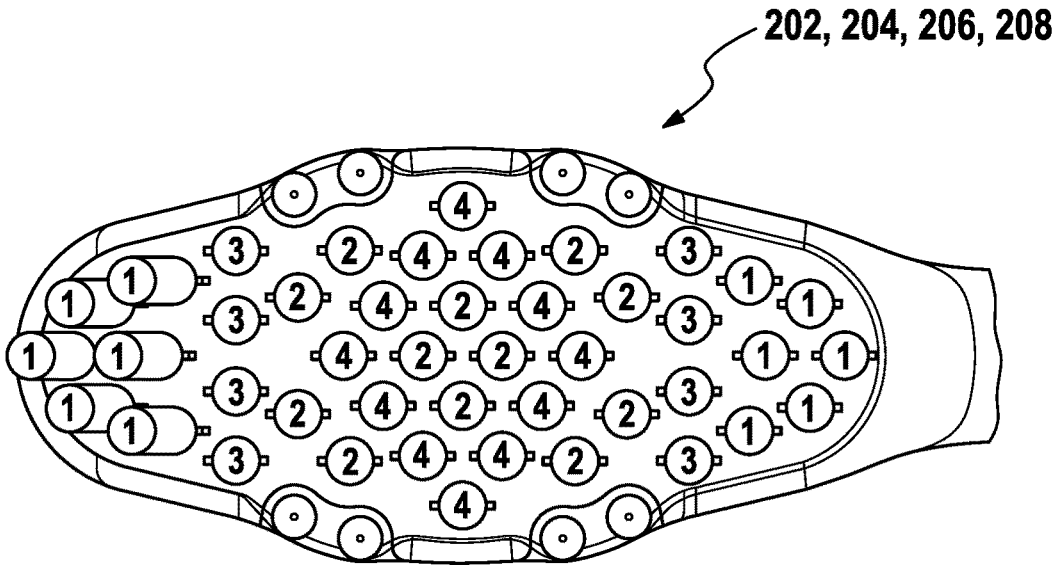
FIG. 12 shows the tuft configuration of the head used to generate the data of FIG. 11.

Arrangement of the tufts of brush heads 202 and 204 is shown in FIG. 12. Tuft configuration of brush heads 202 and 204 is as follows:

| | Brush head 202 | Brush head 204 |
|---|---|---|
| Packing factor | 55% | 49% |
| Diameter of the tufts | 1.7 mm | 1.7 mm |
| Outer diameter 28 of the filament | 0.30 mm | 0.38 mm |

Tuft configuration of brush heads 206 and 208 are apparent from FIG. 12 in connection with the Table 2 and 3. All tufts have a diameter of 1.7 mm

TABLE 2

| Tuft configuration of brush 206 | | | |
|---|---|---|---|
| Location | Material | Filament Diameter | Packing Factor |
| 1 | PA6.12 | 0.165 mm | 73.2% |
| 2 | PA6.12 | 0.165 mm | 73.2% |
| 3 | PA6.12 | 0.178 mm | 74.6% |
| 4 | PA6.12 | 0.152 mm | 73.7% |

TABLE 3

| Tuft configuration of brush 206 | | | |
|---|---|---|---|
| Location | Material | Filament Diameter | Packing Factor |
| 1 | PA6.12 | 0.203 mm | 73.9% |
| 2 | PA6.12 | 0.203 mm | 73.9% |
| 3 | PA6.12 | 0.216 mm | 75.9% |
| 4 | PA6.12 | 0.178 mm | 74.6% |

In the context of this disclosure, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

What is claimed is:

1. A head for an oral care implement, the head having a longitudinal length extension extending between a proximal end and a distal end, an outer rim, and an inner portion, the head comprising at least two tooth cleaning elements of a first type and a plurality of tooth cleaning elements of a second type, the tooth cleaning elements of the first type being arranged at the inner portion of the head, and the plurality of tooth cleaning elements of the second type being arranged at the outer rim of the head, thereby surrounding the tooth cleaning elements of the first type, the tooth cleaning elements of the first type being tufts of a first type, each comprising a plurality of filaments, all of the tufts of the first type being arranged substantially parallel and adjacent to one another, each tuft of the first type having a substantially rectangular or oval elongated cross-sectional shape having a longer length extension and a shorter width extension perpendicular to the longer length extension, wherein the longer length extension is from about 4 mm to about 8 mm and the shorter width extension from about 1.5 mm to about 2.5 mm, and wherein the longer length extensions of each of the tufts of the first type are parallel to one another and define an angle $\alpha$ of about 25° to about 60° with respect to the longitudinal length extension of the head.

2. The head of claim 1, wherein the angle $\alpha$ is selected from the group consisting of an angle of from about 30° to about 45°, an angle of from about 30° to about 35°, and an angle of from about 40° to about 45°.

3. The head of claim 1, wherein the head comprises at least three tufts of the first type.

4. The head of claim 1, wherein the head comprises at least four tufts of the first type.

5. The head of claim 1, wherein the tooth cleaning elements of the second type are tufts of filaments, each tuft having a substantially circular cross-sectional area with a diameter from about 1.5 mm to about 2 mm.

6. The head of claim 1, wherein the tooth cleaning elements of the second type are tufts comprising a plurality of tapered filaments.

7. The head of claim 6, wherein the tooth cleaning elements of the second type are the filaments of the second type of tufts that are longer than the filaments of the first type of tuft.

8. The head of claim 1, wherein each of the filaments of at least one of the tufts of the first type has a longitudinal axis and a substantially cross-shaped cross-sectional area extending in a plane substantially perpendicular to the longitudinal axis, the cross-shaped cross-sectional area having four projections and four channels, the projections and channels being arranged in an alternating manner.

9. The head of claim 8, wherein the tufts of the first type comprising filaments having a cross-shaped cross-sectional area are arranged in an alternating manner with the tufts of the first type comprising filaments having a substantially circular cross-sectional shape.

10. The head of claim 9, wherein the tufts of the first type comprising the filaments having the cross-shaped cross-sectional area have a packing factor from about 40% to about 55%.

11. The head of claim 10, wherein the tufts of the first type have the packing factor from about 45% to about 50%.

12. The head of claim 8, wherein each channel has a concave curvature formed by neighboring and converging projections, the concave curvature having a radius selected from the group consisting of a radius of from about 0.025 mm to about 0.10 mm, a radius of from about 0.03 mm to about 0.08 mm, and a radius of from about 0.04 mm to about 0.06 mm.

13. The head of claim 12, wherein each projection of the cross-sectional area of the filaments of the tuft of the first type is end-rounded thereby forming a curvature having a diameter selected from the group consisting of a diameter from about 0.01 mm to about 0.04 mm, and a diameter of from about 0.018 mm to about 0.026 mm.

14. The head of claim 13, wherein a ratio of the diameter of the curvature of the projection to the radius of the curvature of the channel is selected from the group consisting of a ratio of from about 0.2 to about 1.5, a ratio of from about 0.3 to about 1.0, and a ratio of from about 0.5 to about 0.7.

15. The head of claim 8, wherein the cross-sectional area of each filament of the tuft of the first type has an outer diameter selected from the group consisting of a diameter of from about 0.15 mm to about 0.40 mm, a diameter of from about 0.19 mm to about 0.38 mm, a diameter of from about 0.22 mm to about 0.35 mm, and a diameter of from about 0.24 mm to about 0.31 mm.

16. The head of claim 8, wherein the cross-sectional area of each filament of the tuft of the first type has an outer diameter, and each channel of the filaments of the tuft of the first type has a concave curvature with a radius formed by neighboring and converging projections, and a ratio of the outer diameter to the radius of the concave curvature of the channel is selected from a group consisting of a ratio of from about 2.5 to about 12, and a ratio from about 2.7 to about 9.

17. The head of claim 1, wherein each filament of the tuft of the first type comprises along its longitudinal axis a substantially cylindrical portion and a tapered portion, wherein the tapered portion tapers towards a free end of the filament.

18. The oral care implement of claim 1, wherein the head is structured and configured to be repeatedly attached to and detached from the handle.

19. The head of claim 1, wherein a spacing between the tufts of the first type is from about 0.5 mm to about 0.8 mm.

20. The oral care implement comprising the head of claim 1 and a handle.

21. A head for an oral care implement, the head having a longitudinal axis extending between a proximal end and a distal end, an outer rim, and an inner portion, the head comprising at least two tooth cleaning elements of a first type and a plurality of tooth cleaning elements of a second type, the tooth cleaning elements of the first type being arranged at the inner portion of the head, and the plurality of tooth cleaning elements of the second type being arranged at the outer rim of the head, thereby surrounding the tooth cleaning elements of the first type, the tooth cleaning elements of the first type being tufts of a first type, each comprising a plurality of filaments, the tufts of the first type being arranged substantially parallel to one another, each tuft of the first type having a substantially rectangular or oval elongated cross-sectional shape having a longer length extension and a shorter width extension perpendicular to the longer length extension, wherein the longer length extension is from about 4 mm to about 8 mm and the shorter width extension from about 1.5 mm to about 2.5 mm, and wherein the longer length extension defines an angle $\alpha$ of about 25° to about 60° with respect to the longitudinal length extension of the head, and wherein the longitudinal axis of the head extends through each of the tufts of the first type.

22. A head for an oral care implement, the head having a longitudinal axis extending between a proximal end and a distal end, an outer rim, and an inner portion, the head having a plurality of tooth cleaning elements of a first type arranged at the inner portion of the head, and a plurality of tooth cleaning elements of a second type arranged at the outer rim of the head and surrounding the tooth cleaning elements of the first type, wherein the plurality of tooth cleaning elements of the first type forms at least four tufts of a first type, each comprising a plurality of filaments, all of the at least four tufts of the first type being arranged substantially parallel and adjacent to one another at the inner portion of the head so that the longitudinal axis extends through each of the at least four tufts of the first type, each tuft of the first type having a substantially rectangular or oval elongated cross-sectional shape having a longer length extension and a shorter width extension perpendicular to the longer length extension, wherein the longer length extension is from about 4 mm to about 8 mm and the shorter width extension from about 1.5 mm to about 2.5 mm, and wherein the longer length extension defines an angle $\alpha$ of about 25° to about 60° with respect to the longitudinal length extension of the head.

* * * * *